United States Patent [19]

Besemann

[11] Patent Number: 4,523,502

[45] Date of Patent: Jun. 18, 1985

[54] APPARATUS FOR ACCUMULATING STACKS OF PAPER SHEETS OR THE LIKE

[75] Inventor: Alfred Besemann, Hamburg, Fed. Rep. of Germany

[73] Assignee: E.C.H. Will (GmbH & Co.), Nedderfeld, Fed. Rep. of Germany

[21] Appl. No.: 582,333

[22] Filed: Feb. 22, 1984

[30] Foreign Application Priority Data

Feb. 22, 1983 [DE] Fed. Rep. of Germany ..... 3306066

[51] Int. Cl.[3] ..... B65H 31/30; B65H 35/08

[52] U.S. Cl. ..... 83/71; 83/90; 83/94; 83/153; 414/43; 414/52

[58] Field of Search ..... 83/71, 90, 91, 94, 153; 414/43, 52

[56] References Cited

U.S. PATENT DOCUMENTS

| | | | |
|---|---|---|---|
| 4,201,102 | 5/1980 | Rudszinat | 83/298 |
| 4,255,998 | 3/1981 | Rudszinat | 83/298 |
| 4,285,621 | 8/1981 | Spencer | 414/52 X |
| 4,297,066 | 10/1981 | Ramcke et al. | 414/43 |

FOREIGN PATENT DOCUMENTS 2082547 3/1982 United Kingdom .

*Primary Examiner*—Frank T. Yost

*Attorney, Agent, or Firm*—Peter K. Kontler

[57] ABSTRACT

Apparatus for accumulating stacks of paper sheets has a cross cutter which repeatedly severs several overlapping running paper webs to form a series of groups of overlapping sheets. Such groups are accumulated into layers at a gathering station, and successively formed layers are engaged and withdrawn by a transfer unit which delivers the layers into the range of a withdrawing conveyor serving to deliver the layers to a stack forming station. The operation of the transfer unit is controlled by a rotary camshaft which is driven by the prime mover for the cross cutter through the medium of a computer-controlled step-down transmission arrangement having a compensating transmission whose control shaft is adjustable by the computer, whose input member receives torque from the prime mover and whose output shaft drives the camshaft through the medium of a change-speed transmission, an adjustable planetary transmission, a bevel gear transmission and a gear transmission. The ratio of number of machine cycles (each of which involves the formation of a group of sheets) to a working cycle (involving the withdrawal of a layer from the gathering station) can be varied by the transmission arrangement by varying the frequency at which the transfer unit removes layers from the gathering station. This renders it possible to accumulate stacks wherein the number of sheets need not be a whole multiple of the number of sheets in a layer.

17 Claims, 4 Drawing Figures

APPARATUS FOR ACCUMULATING STACKS OF PAPER SHEETS OR THE LIKE

BACKGROUND OF THE INVENTION

The present invention relates to apparatus for accumulating stacks of paper sheets or the like. More particularly, the invention relates to improvements in apparatus of the type having (a) a cross cutter which repeatedly severs several superimposed running webs of paper or a like flexible material so as to form a series of groups of overlapping sheets wherein the number of sheets equals the number of overlapping webs, (b) means for gathering several groups into layers of superimposed sheets, and (c) means for accumulating several layers into discrete stacks.

Commonly owned German Offenlegungsschrift No. 31 27 569 and commonly owned copending U.S. Pat. No. 4,474,093 of Neubüser et al. discloses an apparatus wherein the layers which consist of several groups of superimposed sheets are removed from the gathering station by a transfer device having a tongs with jaws arranged to engage the topmost and lowermost sheets of a layer and a camshaft carrying several rotary cams which initiate and control the movements of the transfer device between the gathering station and a removing conveyor which delivers layers of the stacking station. The arrangement is such that the transfer of a layer takes place subsequent to the gathering of several groups of sheets into such layer, i.e., the number of machine cycles (each machine cycle involves the making of a group of r sheets) is several times the number of working cycles (each working cycle involves the transfer of a layer from the gathering station into the range of the aforementioned removing conveyor). The apparatus of Neubüser et al. further comprises means for varying the number of machine cycles per working cycle in order to enhance the versatility of the apparatus by rendering it possible to accumulate stacks having widely different numbers of sheets.

Apparatus of the type disclosed by Neubüser et al. are used in modern production lines wherein stacks of overlapping paper sheets of the like must be accumulated at a high frequency, for example, to be introduced into discrete cardboard boxes or to be converted into calendars, exercise books, steno pads and/or other stationery products. A first step in speeding up the formation of successive stacks is the provision of a cross cutter which forms groups of overlapping sheets wherein the number r of sheets equals the number of overlapping running webs which are severed during each machine cycle. A group constitutes the smallest unit for the assembly of a stack, i.e., the number of sheets in a stack is necessarily a whole multiple of the number of sheets in a single group. As mentioned above, the groups are accumulated into layers each of which contains several groups, and such layers are thereupon transferred to the stacking station where a certain number of layers is accumulated into a complete stack. The removal of finished stacks from the stacking station and the preparation of the stacking station for accumulation of the next stack takes up a certain interval of time which cannot be shortened at will and which imposes limits upon the number of stacks that can be accumulated per unit of time. Thus, the frequency of the aforediscussed working cycles cannot be increased beyond that which is permissible in view of the minimum duration of an interval of removal of a finished stack from and of preparation of the stacking station for reception of the first layer of the next-following stack.

The accumulation of groups of sheets into layers is intended to provide longer intervals of time for removal of a stack from the stacking station. This will be readily appreciated by bearing in mind that the interval for removal of a freshly formed stack is much shorter if such stack is formed of a large number of discrete groups (of e.g., six sheets each) than if the stack is formed or a smaller number of successive layers each of which contains several groups of sheets (e.g., a total of thirty sheets).

The reasons for varying the number of machine cycles per working cycle during the formation of a stack are as follows: If the stack is accumulated from a succession of layers rather than from a succession of groups, and the number of groups per layer is always the same, the number of sheets in each of the stacks is necessarily a whole multiple of the number of sheets per layer. For example, if a layer invariably contains thirty sheets, the number of sheets in a layer can be a whole multiple of thirty which greatly limits the versatility of the stack forming apparatus. However, if a stack is assembled of several sets of layers each of which contains a different number of sheets, the number of sheets per stack can be varied within a much wider range, i.e., the total number of sheets per stack is then a multiple of the number r of sheets in a group.

In the apparatus of Neubüser et al., a first prime mover is utilized to drive the cross cutter and a discrete second prime mover is provided to drive the camshaft for the transfer device which delivers successive layers from the gathering station into the range of the aforementioned removing conveyor. A computer is provided to synchronize the operation of the cross cutter with that of the transfer device.

OBJECTS AND SUMMARY OF THE INVENTION

An object of the invention is to provide an apparatus wherein a single prime mover suffices to drive the cross cutter (i.e., the means for forming successive groups of overlapping sheets) and the transfer device which delivers successive layers (each of which contains several groups of sheets) into the range of the conveyor which transfers the layers to the stacking station.

Another object of the invention is to provide an apparatus wherein the prime mover of the production line which processes the stacks of paper sheets or the like can transmit motion to the cross cutter as well as to the transfer device.

A further object of the invention is to provide an apparatus wherein the number of machine cycles per working cycle can be varied within a desired range in spite of the fact that the cross cutter and the transfer device receive motion from a common prime mover.

An additional object of the invention is to provide the apparatus with novel and improved means for driving the transfer device.

Another object of the invention is to provide a novel and improved control system which can synchronize the operation of the cross cutter with that of the transfer device.

An ancillary object of the invention is to provide a novel and improved composite transmission for use in the above outlined apparatus.

A further object of the invention is to provide a novel and improved method of gathering successive stacks of paper sheets or the like from layers each of which contains several groups containing identical numbers of superimposed sheets.

Another object of the invention is to provide a production line which embodies the above outlined apparatus.

The invention is embodied in an apparatus for forming stacks from sheets which consist of paper or a like flexible material (e.g., sheets of synthetic plastic material, metallic foil or the like). The apparatus comprises a first station (group forming station) and a second station (stack forming station), mobile severing means (such as a commercially available cross cutter) for repeatedly severing overlapping plural running webs of flexible material so as to form a series of groups of overlapping sheets, belt conveyors or other suitable means for supplying successive groups of the series to the first station, means (e.g., a suitable stop) for gathering groups at the first station into a succession of layers, transfer means (e.g., a pivotable and/or reciprocable tongs) for transporting successive layers from the first station toward the second station (where the layers are gathered into a stack) at a variable frequency so that the number of groups per layer is a function of such frequency, a variable-speed electric motor or another suitable prime mover, means for transmiting motion from the prime mover to the transfer means including a transmission arrangement with a whole-number step-down transmission ratio, and regulating means for varying the frequency of removal of layers from the first station in accordance with a predetermined program through the medium of the transmission arrangement.

The transmission arrangement preferably comprises a compensating transmission having an input member (e.g., a rotary toothed cage) which receives torque from the prime mover, an output member which is operatively connected with the transfer means, and a mobile control member which is arranged to receive motion from the regulating means and to thereby vary, through the medium of the output member, the frequency of removal of layers from the first station. The motion transmitting means further comprises a rotary camshaft which receives torque from the output member of the compensating transmission and serves to drive the transfer means.

The transmission arrangement further comprises a multi-stage change-speed transmission which is interposed between the output member of the compensating transmission and the camshaft. Still further, the transmission arrangement comprises means for changing the phase of the transfer means (e.g., to ensure that the transfer means can engage a freshly formed layer at the optimum instant between the delivery to the first station of a preceding group belonging to the layer which is about to be removed and of the next-following group which is intended to form part of the next layer). Such phase changing means can include an adjustable planetary transmission which is interposed between the output member of the compensating transmission and the camshaft, preferably between the change-speed transmission and the camshaft. The planetary transmission can comprise a rotary input element which receives torque from the output member of the compensating transmission (e.g., by way of the change-speed transmission), a planet carrier which is driven by the input element, a sun gear which transmits torque to the camshaft, at least one planet pinion rotatably mounted in or on the planet carrier and meshing with the sun gear, a ring gear which meshes with the planet pinion(s), and means (e.g., a manually or motorically driven feed screw) for adjusting the angular position of the ring gear to thereby change the phase of the transfer means.

The regulating means preferably comprises a step-by-step servomotor which can rotate the control member of the compensating transmission in a clockwise or counterclockwise direction to thereby change the frequency of removal of layers from the first station, a second motor (e.g., a gear motor) which serves to drive the servomotor in accordance with the predetermined program, and a computer which transmits signals to the second motor, e.g., by way of a dividing circuit.

The apparatus preferably further comprise means for transmitting motion from the prime mover to the severing means, i.e., one and the same prime mover can drive the transfer means as well as the severing means in spite of the fact that the frequency of removal of layers from the first station is variable in accordance with a selected program. Still further, the apparatus can comprise means (such as a thyristorized signal comparing stage) for varying the speed of the prime mover to thereby vary the frequency at which the cross cutter severs the webs as well as to influence the frequency of removal of layers from the first station.

The transmission arrangement can further comprise a bevel gear transmission which is preferably interposed between the sun gear of the aforementioned plantery transmission and the camshaft, and the means for transmitting motion from the prime mover to the transfer means preferably further comprises a gear transmission which is interposed between the bevel gear transmission and the camshaft. A removing conveyor (e.g., a set of cooperating belt conveyors) can be provided to transport layers from the transfer means to the second station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
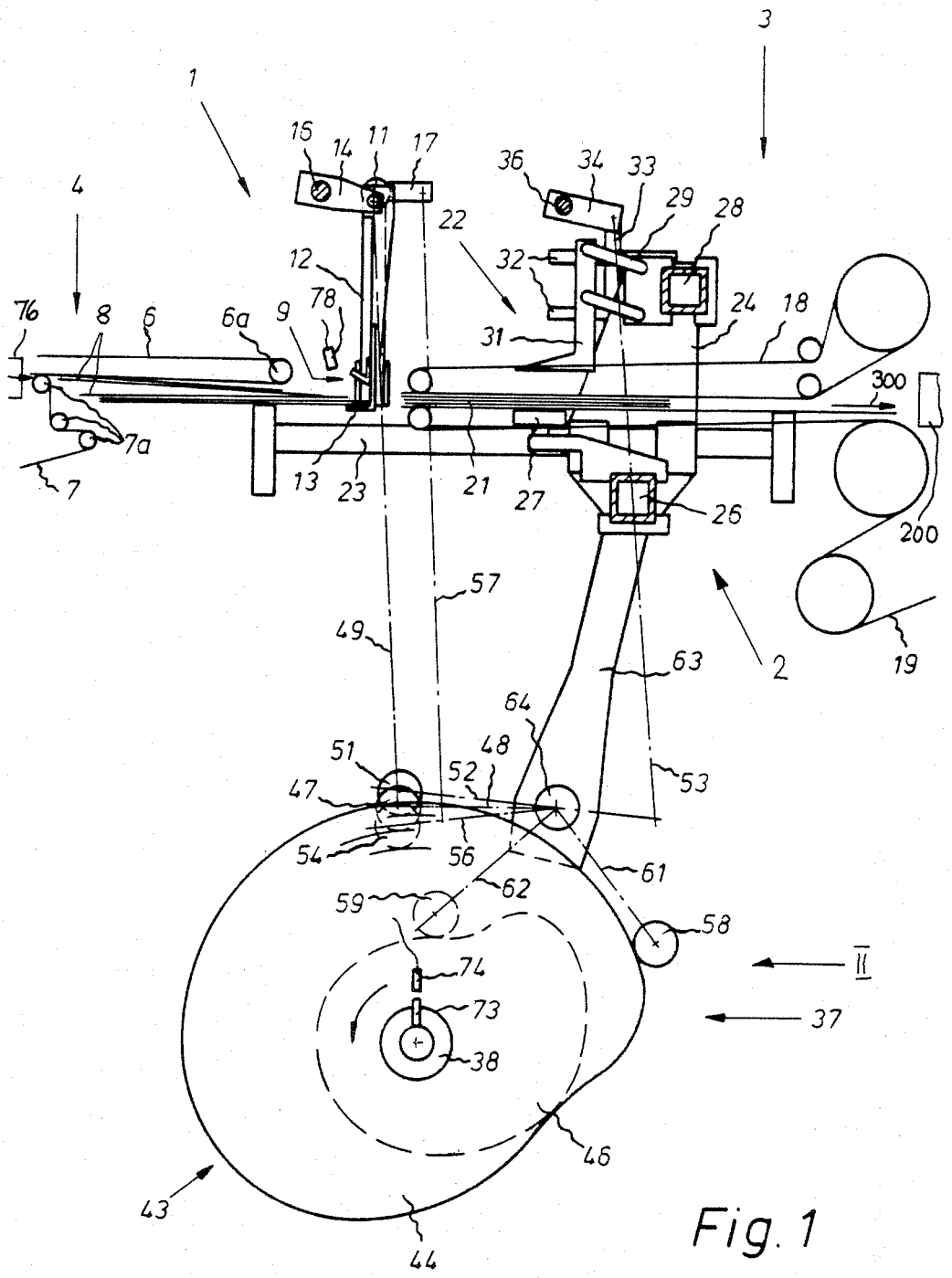
FIG. 1 is a schematic partly elevational and partly sectional view of an apparatus which embodies one form of the invention and wherein the gathering station is in the process of accumulating a fresh layer of groups of sheets while the previously assembled layer is in the process of being delivered to the stacking station.
Figure 2:
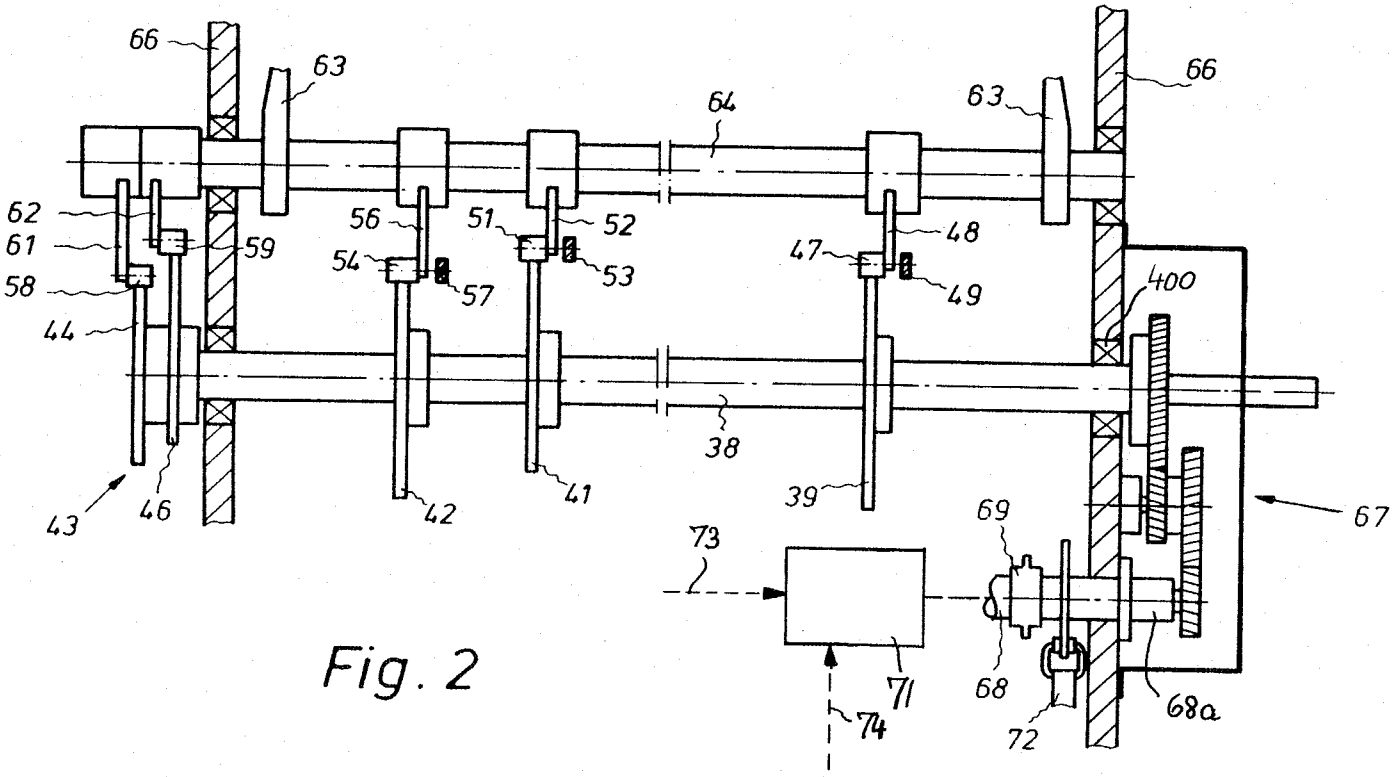
FIG. 2 is a partly vertical sectional view and a partly elevational view of the apparatus as seen in the direction of arrow II in FIG. 1.

Referring first to FIGS. 1 and 2, they show a portion of a paper processing machine which includes means for converting several webs (coherent sheets) 77 of paper into groups 8 of superimposed (overlapping) sheets and which thereupon converts such groups into stacks which are accumulated at a stacking (second) station 200. The webs 77 are drawn off discrete sources in the form of reels or bobbins 100 of which only two are shown in the upper left-hand portion of FIG. 3. The severing means for subdividing the webs 77 into groups 8 of superimposed sheets each of which contains a predetermined number (r) of sheets includes a cross cutter 76, e.g., a cross cutter of the type disclosed in U.S. Pat. Nos. 4,201,102 and 4,255,998 to Rudszinat (see also FIG. 3). The number (r) of sheets in a group 8 matches the number of reels 100. The webs 77 which advance from the respective reels 100 toward the severing or subdividing station accommodating the cross cutter 76 overlie or overlap each other so that the orbiting knives 76*a* on the two rotary knife holders 76*b* of the cross cutter 76 can simultaneously sever r webs 77, i.e., each cutting or severing operation results in the formation of a group 8 consisting of r overlapping or superimposed sheets. The rate at which the groups 8 are produced is a function of the frequency at which the cross cutter 76 severs the coherent sheets or webs 77.

The apparatus which includes the component parts disposed between the severing means or cross cutter 76 and the stacking station 200 includes a (first) station 1 which can be referred to as a preliminary gathering or preassembling station for selected (variable) numbers of groups 8. The means for supplying successive groups 8 of overlapping sheets from the severing means (cross cutter 76) to the station 1 (hereinafter called gathering station) comprises a first conveyor or supply conveyor 4, and the means for transporting selected numbers of gathered groups 8 (hereinafter called layers 21) from the gathering station 1 to the stacking station 200 comprises a transfer unit 2 and a second or removing conveyor 3. The purpose of the transfer unit 2 is to deliver successively gathered layers 21 from the station 1 into the range of the conveyor 3 which latter advances such layers to the stacking station 200. The transfer unit 2 comprises a gripper or tongs 22 which is movable back and forth, as considered in the direction of transport of layers 21 from the gathering station 1 to the stacking station 200. Such direction is indicated by the arrow 300.

The supply conveyor 4 comprises a plurality of pairs of discrete endless belt or band conveyors each of which includes an upper endless belt 6 and a lower endless belt 7. The belts 6 are trained over pulleys 6*a* of which only one can be seen in the upper left-hand portion of FIG. 1, and the belts 7 are trained over pulleys 7*a* three of which are shown in the upper left-hand portion of FIG. 1. Each upper belt 6 is disposed in a vertical plane which is common to the plane of the respective lower belt 7. The groups 8 which are formed at the severing or subdividing station are engaged by the lower reaches of the upper belts 6 and by the upper reaches of the lower belts 7 and are thereby advanced along a substantially horizontal path and on to the gathering station 1.

In the embodiment which is shown in the drawing, each holder 76*b* carries a single knife 76*a*. Therefore, each revolution of a holder 76*b* results in the formation of a single group 8 of r superimposed paper sheets. However, it is equally within the purview of the invention to equip each of the holders 76*b* with several knives 76*a* so that each revolution of a holder results in the formation of two or more groups of paper sheets.

The apparatus further comprises an adjustable gathering device or stop 9 which is installed at the gathering station 1 and preferably consists of a series of aligned levers 12 secured to a horizontal shaft 11. The shaft 11 carries the upper end portions of the levers 12, and the lower end portion of each lever 12 has a bent-over portion or pallet 13 which is normally located at a level below the path of an oncoming group 8 and faces in a direction toward the discharge end of the supply conveyor 4, i.e., toward the severing of subdividing station accommodating the cross cutter 76.

The end portions of the shaft 11 are mounted on the right-hand end portions of two levers 14 of which only one can be seen in FIG. 1. The levers 14 are pivotable about the axis of a horizontal shaft 16 which is parallel to the shaft 11. Each lever 12 comprises a substantially horizontal projection 17 which is located at a level close to or matching that of the shaft 11. Therefore, each of the levers 12 can be said to constitute a two-armed lever the lower arm of which carries the respective pallet 13 and the upper arm of which is constituted by the respective projection 17.

The end portions of the shaft 16 are journalled in two frame members 66 shown in FIG. 2. The arrangement is such that the gathering device or stop 9 moves up or down in response to pivoting of the levers 14 (which carry the shaft 11) about the axis of the shaft 16, and that the stop 9 (i.e., each of its levers 12) pivots to move the pallets 13 forwardly or backwards (i.e., in and counter to the direction indicated by the arrow 300 of FIG. 1) in response to pivoting of the levers 12 about the axis of the shaft 11. This renders it possible to advance a fully assembled layer 21 from the station 1 into the range of the removing conveyor 3 when the stop 9 is lifted and is thus moved out of the way, or to return the stop 9 to the position of FIG. 1 in which its pallets 13 support the leader of the lowermost group 8 at the station 1 and the groups 8 above such lowermost group are caused to neatly overlie each other by striking against the lower arms of the levers 12 above the pallets 13.

The removing conveyor 3 is analogous to the supply conveyor 4. Thus, the removing conveyor 3 also comprises several pairs of superimposed endless belt or band conveyors including an upper endless belt 18 and a lower endless belt 19 which is coplanar with the respective upper belt 18. A layer 21 which contains a predetermined number of superimposed groups 8 can be engaged by the lower reaches of the upper belts 18 and by the upper reaches of the lower belts 19 for transfer to the stacking station 200. The exact construction of the mechanism or mechanisms at the stacking station 200 forms no part of the present invention. Reference may be had, for example, to commonly owned U.S. Pat. No. 4,249,844 granted Feb. 10, 1981 to Siegfried Lampe et al. For the sake of convenience, the disclosure of this United States Letters Patent is also incorporated herein by reference. It will be understood, however, that any other suitable stacking device which can accumulate two or more layers 21 into a taller layer or stack can be usd with equal advantage.

The tongs 22 of the transfer unit 2 is mounted on a carriage or support 24 which is reciprocable along guide rails 23 in and counter to the direction indicated by the arrow 300, i.e., toward and away from the gathering station 1 as well as away and toward the stacking station 200. More specifically, the tongs 22 is reciprocable along a relatively short path so that it can engage a layer 21 which is assembled at the gathering station 1 and can advance such layer well into the range of the removing conveyor 3. The rails 23 flank the path for the layers 21. The carriage 24 for the tongs 22 includes or supports a lower crosshead 26 which is located at a level below the adjacent end portions of the lower belts 19 and extends transversely of the direction which is indicated by the arrow 300. The crosshead 26 serves to support the lower portion or jaw 27 of the tongs 22. A second horizontal crosshead 28 of or on the carriage 24 is located at a level above the adjacent end portions of the belts 18 and indirectly supports the articulately mounted upper portion or jaw 31 of the tongs 22. The connection between the upper crosshead 28 and the jaw 31 comprises a set of parallel links 29 having first end portions articulately connected with the crosshead 28 (or with a part which is supported by the crosshead 28) and second end portions articulately connected with the upper portion of the upper jaw 31. The means for moving the upper jaw 31 toward and away from the lower jaw 27 of the tongs 22 comprises a substantially vertically reciprocable bolt 33 which is indirectly coupled with the jaw 31 by rails 32 and is articulately connected to one end portion of a lever 34. The other end portion of the lever 34 is pivotable about the axis of a horizontal shaft 36.

The means 37 for imparting motion to and for adjusting the stop 9, the upper jaw 31 of the tongs 22 and the carriage 24 comprises a transmission which is shown in FIGS. 1 and 2 and comprises a horizontal camshaft or timing shaft 38 for a set of disc-shaped cams 39, 41, 42 and 43 (see particularly FIG. 2). The cam 43 (hereinafter called positive-action cam) serves to positively drive the part or parts which receive motion therefrom and is a composite cam assembled of two disc cams 44 and 46 which are rigidly connected to each other.

The cam 39 is tracked by a roller follower 47 and serves to effect upward and downward movements of the stop 9 by way of a linkage including the links 48 and 49. The link 49 is attached to the shaft 11 and the link 48 is mounted on a shaft 64 and is articulately connected with the link 49. The roller follower 47 is mounted at the junction of the links 48 and 49.

The cam 41 is tracked by a roller follower 51 and serves to open and close the tongs 22. The connection between the roller follower 51 and the means for moving the upper jaw 31 of the tongs 22 toward or away from the lower jaw 27 comprises a pair of articulately connected links 52 and 53.

The periphery of the cam 42 is tracked by a third roller follower 54 and this cam serves to effect forward and rearward movements of the pallets 13 at the lower ends of the levers 12 constituting the stop 9. The operative connection between the projections 17 of the levers 12 and the cam 42 further comprises a pair of links 56 and 57.

The positive-action cam 43 is tracked by two roller followers 58 and 59 which respectively engage the peripheries of the disc cams 44 and 46 (see FIG. 2) and cooperate with links 61 and 62 as well as with two levers 63 in order to shift the carriage 24 back and forth, namely, in and counter to the direction which is indicated by the arrow 300. The links 48, 52, 56, 61 and 62 are mounted on the shaft 64 which is rotatably journalled in the frame members 66 of the apparatus. The shaft 64 is parallel to the camshaft 38 and each of these shafts is rotatable in antifriction bearings 400 shown in FIG. 2.

The means for continuously rotating the camshaft 38 is illustrated in the lower right-hand portion of FIG. 2. Such rotating means comprises a transmission arrangement 71 with a whole-number step-down transmission ratio. The output element 68 of the transmission arrangement 71 drives an overrunning clutch 69. The clutch 69 transmits torque to the camshaft 38 through the medium of a gear transmission 67. The reference character 72 schematically denotes a braking device for a shaft **68*a* which is driven by the clutch 69 and transmits rotary motion to the first gear of the gear transmission 67**.

The arrow 73 which is shown in FIG. 2 denotes an operative connection between the transmission arrangement 71 and the main prime mover 78 (FIG. 3) of the machine. The arrow 74 denotes the operative connection between the transmission arrangement 71 and an element 86 of a regulating unit which is shown in the lower part of FIG. 3.

Figure 3:
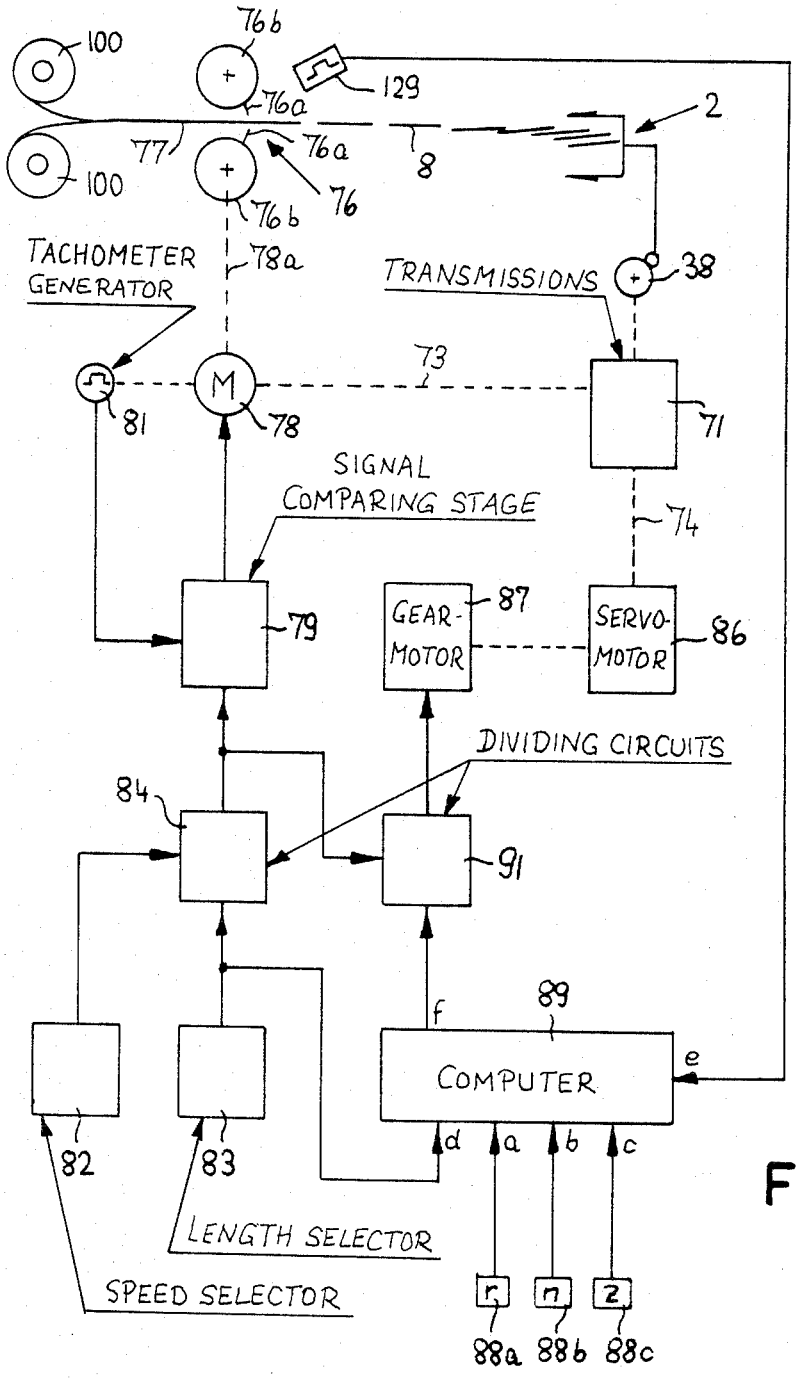
FIG. 3 is a diagram of the controls for the cross cutter and the transfer unit.

FIG. 3 merely shows two reels or bobbins 100 for discrete running webs 77 of paper or the like. In actual practice, the machine can employ a cross cutter 76 or an analogous severing means which simultaneously severs any desired practical number of webs 77 to form groups 8 containing r sheets wherein r is the number of reels or bobbins 100, i.e., the number of discrete webs 77.

The speed of the main prime mover 78 of the machine (this prime mover can constitute a variable-speed electric motor) is monitored by a tachometer generator 81 which transmits signals denoting the RPM of the prime mover 78 to a control element 79, e.g., a thyristorized signal comparing stage of conventional design. The speed of the prime mover 78 can be selected by a speed selector unit 82 (this unit thus determines the speed of lengthwise movement of the webs 77 because the prime mover 78 drives the rotary knife holders **76*b* of the cross cutter 76 whose speed is synchronized with the speed of the webs 77). A length selector unit 83 is provided to select the length of discrete sheets which form the groups 8 and layers 21 as well as the stacks which are assembled of layers 21. The outputs of the selector units 82, 83 are connected to the corresponding inputs of a dividing circuit 84; the latter generates signals corresponding to the quotient of signals respectively denoting the selected speed of the webs 77 and the selected length of discrete sheets and transmits such (reference) signals to the control element 79 for the prime mover 78 which drives the knife holders 76*b* of the cross cutter 76 at a corresponding RPM. The control element 79 is the control circuit for the prime mover 78. This element transmits an RPM-adjusting signal when the monitored RPM of the prime mover 78 deviates from that which is denoted by the signal at the output of the dividing circuit 84**.

The camshaft 38 is driven by the transmission arrangement 71 which, in accordance with a feature of the invention, is driven by the prime mover 78 by way of the operative connection 73. In order to vary the number of machine cycles per working cycle, the transmission arrangement 71 is regulated by a gear motor 87 by way of the element 86 which constitutes a step-by-step servomotor.

An evaluating device of the regulating unit, here shown as a computer 89, has inputs a, b, and c which are respectively connected with selectors **88*a* for the number r of sheets per group 8, 88*b* for the number n of sheets per stack, and 88***c* for the number z of groups 8 per layer 21 to be accumulated at the gathering station 1. A further input d of the computer 89 is connected with the output of the length selector unit 83 for discrete sheets of a stack. The output f of the computer 89 is connected with one input of a dividing circuit 91 which forms signals denoting the quotient of the reference signal for the speed of the cross cutter 56 and the number z of groups 8 per layer 21. The signal at the output of the dividing circuit 91 is the reference signal for the speed of the composite transmission 71 which drives the transfer unit 2. Such reference signal is used to adjust the gear motor 87 for the servomotor 86 which, in turn, can change the ratio of the transmission arrangement 71 and hence the speed at which the transmission arrangement 71 rotates the camshaft 38. In the circuit diagram of FIG. 3, the electrical connections between various components are indicated by solid lines and the kinematic connections are indicated by broken lines.

Figure 4:
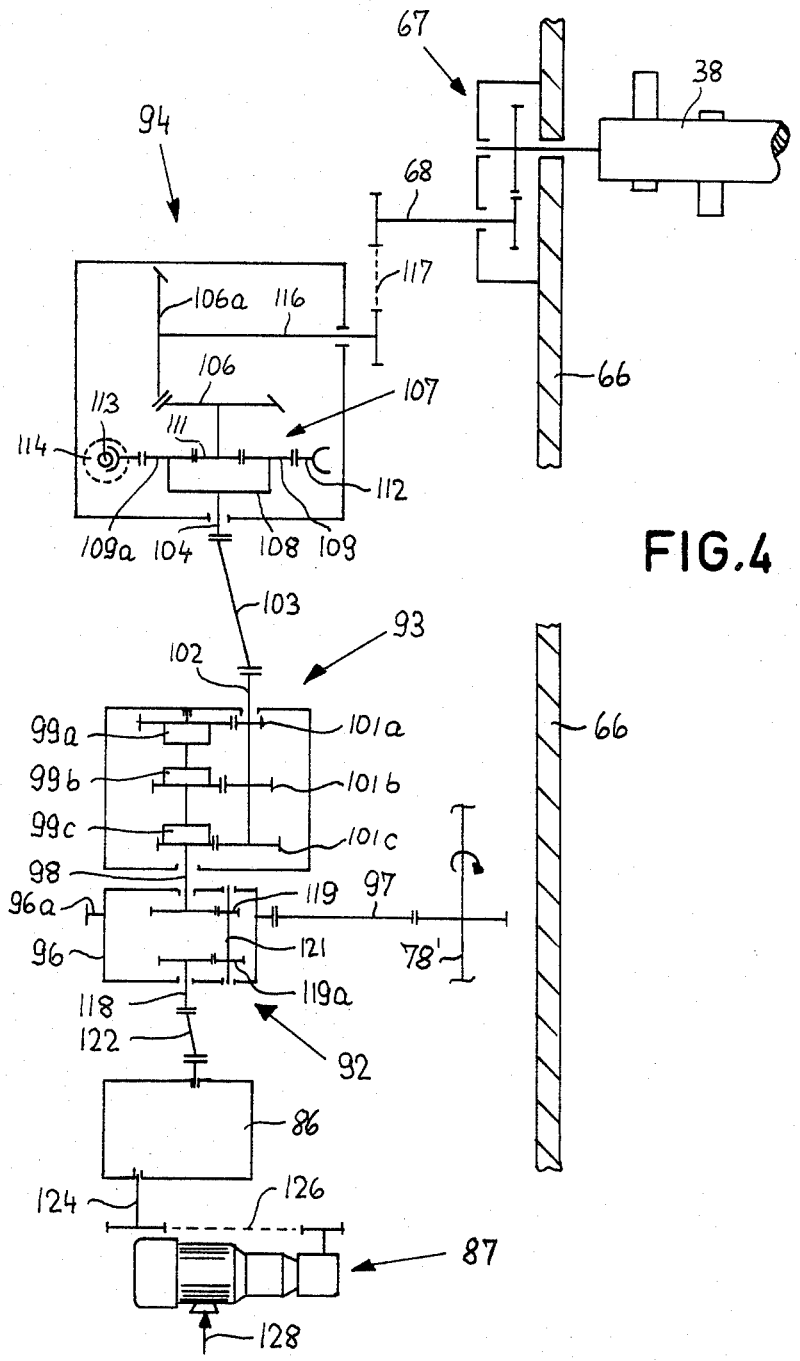
FIG. 4 is a schematic sectional view of the composite transmission which is interposed between the prime mover and the transfer unit.

FIG. 4 illustrates a presently preferred embodiment of the transmission arrangement 71. This transmission arrangement includes a series connection of a compensating or differential transmission 92, a multi-stage change-speed transmission 93 and a bevel gear transmission 94.

The compensating transmission 92 comprises an input member in the form of a cage 96 which is provided with an annulus of external teeth 96*a* in mesh with the teeth of a driver gear 97 on the output shaft 78' of the prime mover 78. The output shaft 98 of the differential transmission 92 is the input shaft of the change-speed transmission 93 which, in the illustrated embodiment, comprises three stages. The stages (i.e., the transmission ratios) of the transmission 93 can be selected by electromagnetic clutches 99*a*, 99*b* and 99*c*. These clutches are designed to respectively transmit torque from the input shaft 98 to the output shaft 102 of the transmission 93 by way of a first gear train 101*a* (clutch 99*a*), a second gear train 101*b* (clutch 99*b*) and a third gear train 101*c* (clutch 99*c*). The output shaft 102 of the transmission 93 is connected with the input shaft 104 of the bevel gear transmission 94 by way of a universal joint 103 (such as a cardanic shaft). The transmission 94 comprises two bevel gears 106, 106*a* the former of which can receive torque by way of an adjustable synchronization or phase correcting planetary transmission 107. The planet carrier 108 of the transmission 107 receives torque from the input shaft 104 and carries two planet pinions 109, 109*a* each of which meshes with a sun gear 111 as well as with an internallly toothed cage (ring gear) 112. The sun gear 111 drives the first bevel gear 106. The cage 112 further comprises an annulus of external teeth in mesh with a feed screw 113 which is rotatable by a handwheel 114 so as to change the angular position of the cage 112 and to thereby vary the phase of the transfer unit 2. This cage is normally stationary. The output shaft 116 of the bevel gear transmission 94 is driven by the second bevel gear 106*a* and transmits torque to one pulley or sprocket wheel of a toothed belt transmission 117 which drives the shaft 68. The latter transmits torque to the input shaft of the gear transmission 67 by way of the clutch 69 which is shown in FIG. 2.

The control shaft 118 of the differential transmission 92 is coupled to the output of the change-over step gear 86 by a universal joint 122, e.g., a cardanic shaft. The transmission 92 further comprises intermediate gears 119, 119*a* which have different diameters and are mounted on a shaft 121 which is journalled in the cage 96. The input shaft 124 of the change-over step gear 86 is driven by the gear motor 87 through the medium of a toothed belt transmission 126. The arrow 128 in the lower portion of FIG. 4 denotes the operative connection between the gear motor 87 and the dividing circuit 91.

The fact that the groups 8 of r sheets each are gathered at the station 1 into layers 21 entails that the layers 21 constitute the smallest units of successively assembled stacks (such stacks are assembled at the station 200). Thus, basic mathemetic considerations will convince that a stack which is expected to be assembled comprises a total of n sheets wherein n equals a whole multiple of $r \times z$ (r is the number of sheets in a group 8 and z is the number of groups 8 in a layer 21). If this were the only possibility of accumulating stacks having different numbers of sheets, the number of different stacks (i.e., of stacks containing different numbers of sheets) would be very restricted. This is avoided by the novel expedient of varying the number of machine cycles per working cycle. The result is that a stack can contain any number n of sheets wherein n is divisible by r, i.e., by the number of discrete sheets in a group 8.

In order to achieve such different ratios of machine cycles per working cycle, i.e., in order to vary the number of machine cycles per working cycle, the speed of the camshaft 38 is changed from a first speed $v_1$ (basic speed) to a second speed $v_2$ (corrected or modified speed) during the assembly of a stack. When the camshaft 38 is driven at the basic speed $v_1$, each working cycle corresponds to $z_1$ machine cycles, i.e., the station 1 accumulates $z_1$ groups 8 into a layer 21. If the speed of the camshaft 38 is changed from $v_1$ to $v_2$, each working cycle corresponds to $z_2$ machine cycles, i.e., each layer 21 then contains a different number of groups 8. Thus, the number n of sheets in a stack will equal $p \times r \times z_1 + q \times r \times z_2$ wherein p is the number of working cycles which are performed while the camshaft 38 is driven at the speed $v_1$ (i.e., the number of layers 21 which are assembled while the camshaft 38 is driven at the speed $v_1$), $z_1$ is the number of machine cycles per working cycle while the camshaft 38 is driven at the speed $v_1$, q is the number of working cycles while the camshaft 38 is driven at the speed $v_2$ (i.e., the number of layers 21 which are assembled while the camshaft 38 is driven at the speed $v_2$), and $z_2$ is the number of machine cycles per working cycle while the camshaft 38 is driven at the speed $v_2$. The number of sheets in each layer 21 which is assembled while the speed of the camshaft 38 equals $v_1$ is $z_1 \times r$, and the number of sheets in each layer which is assembled when the camshaft 38 is driven at the speed $v_2$ equals $z_2 \times r$. The ratio n/r is a whole number.

It is now assumed that the machine should accumulate at least one stack which contains $n=498$ sheets. It is further assumed that the cross cutter 76 forms groups 8 each of which contains $r=6$ sheets (i.e., the total number of reels 100 is six). Each machine cycle involves one revolution of the two knife holders 76*b*, i.e., the making of a group 8. If the speed of the transfer unit 2 were constant at all times, i.e., if the frequency at which the cross cutter 76 severs the webs 77 were constant during the accumulation of a full stack (at the station 200), the number of sheets in a stack would always equal a whole multiple of $z \times r$ wherein z is the number of groups 8 in a layer 21 and r is the number of sheets in a group 8. For example, if $z=5$, and the number of machine cycles during a working cycle is constant during the accumulation of a full stack, such a stack can have 480 or 510 sheets but cannot contain 498 sheets. This will be readily appreciated since, under such circumstances, each layer 21 invariably contains thirty sheets.

However, and since the transfer unit 2 is capable of transferring layers 21 from the station 1 into the range of the conveyor 3 at several speeds, the number $z_1$ of groups 8 in a layer 21 is different from the number $z_2$ of groups 8 in a layer 21 when the transfer unit 2 respectively operates at the speeds $v_1$ and $v_2$. In other words, the frequency at which the transfer unit 2 delivers layers 21 from the station 1 to the conveyor 3 during a first stage of accumulation of a given stack is different from the frequency at which the layers 21 are transferred during the second stage of accumulation of the same stack. This renders it possible to accumulate stacks, each of which contains n=498 sheets, in the following way:

The computer 89 is preferably a process control computer which receives information pertaining to the values of r, n and z from the corresponding selectors 88*a*, 88*b* and 88*c*. In the aforementioned example, r=6 and n=498. The selector 88*c* furnishes information denoting the value of $z_1$, i.e., the number of groups 8 per layer 21 when the speed equals $v_1$. It is assumed that $z_1=5$, i.e., each layer 21 then contains a total of thirty sheets. The ratio of machine cycles to a working cycle is five to one. The computer 89 then automatically selects an appropriate value for $z_2$, i.e., for the number of groups 8 in a layer 21 when the transfer unit 2 is operated at the speed $v_2$, namely when the ratio of machine cycles per working cycle is altered from $z_1$:1 to $z_2$:1. This is accomplished by selecting for $z_2$ a value which equals $z_1+1=6$. Thus, the apparatus is set to accumulate a certain number of layers 21 each of which contains thirty sheets and a certain number of layers 21 each of which contains thirty-six sheets. The signal from the selector unit 82 denotes the machine speed and the signal from the selector unit 83 denotes the length of discrete sheets. The dividing circuit 84 generates a reference signal which is indicative of the quotient signals from the units 82 and 83 and which is transmitted to the control element 79 so that the latter selects the speed of the cross cutter 76 by effecting an appropriate correction of the speed of the prime mover 78. The latter also drives the camshaft 38 by way of the transmissions 92, 93 and 94 of the transmission assembly 71 in such a way that the duration of each working cycle (transfer of a layer 21 from the station 1 into the range of the conveyor 3) takes up an interval of time which is a whole multiple of a machine cycle (the making of a group 8). At the start of the gathering of a stack, the ratio of machine cycles to a working cycle ($z_1$:1) is five-to-one (this is due to the aforementioned setting of the computer 89 via selector 88*c*).

The frequency at which the cross cutter 76 severs the webs 77 is detected by a sensor 129 which transmits appropriate signals to the input e of the computer 89. In other words, the signal from the sensor 129 is indicative of the number $z_1$ of machine cycles per working cycle. The computer 89 then ascertains the values of p and q in the aforementioned equation $$n=(z_1\times r)\times p+(z_2\times r)\times q.$$

Thus, the computer 89 ascertains that number (p) of layers 21 (each of which contains thirty sheets) and that number of layers 21 (each of which contains thirty-six sheets) which together make a stack containing 498 sheets. The corresponding signal is transmitted from the output f of the computer 89 to the dividing circuit 91 whose output transmits a reference signal denoting the quotient of the signal from the output f of the computer 89 and the signal from the output of the dividing circuit 84, and such reference signal is transmitted to the input of the gear motor 87. The phase length and duration of the reference signal at the output of the dividing circuit 91 are such that the gear motor 87 transmits to the input shaft 124 of the step-by-step servomotor 86 a torque by way of the toothed belt transmission 126. The servomotor 86 transmits such torque to the control shaft 118 of the differential transmission 92. The control shaft 118 causes the transmission 92 to subtract one revolution of the shaft which drives the knife holders 76*b* during each working cycle. In other words, instead of making five groups 8 while the transfer unit 2 removes a layer 21 from the station 1 into the range of the conveyor 3, the cross cutter 76 makes six groups 8 so that the number of sheets per layer 21 is increased from thirty to thirty-six. Otherwise stated, the frequency at which the transfer unit 2 removes layers 21 from the station 1 is reduced according to the ratio of $v_1$ to $v_2$, i.e., the number of groups 8 per layer 21 is increased from $z_1$ (=5) to $z_2$ (=6).

In the aforementioned example, the computer 89 determines that p=13 and q=3. Thus, the camshaft 38 first induces the transfer unit 2 to complete a total of thirteen working cycles during which each transferred layer 21 contains thirty sheets and to thereupon complete a total of three working cycles during each of which the number of sheets per layer 21 equals thirty-six. The control shaft 118 of the differential transmission 92 is idle during the first thirteen cycles. When the fourteenth cycle begins, the growing stack at the station 200 contains a total of 390 sheets, namely $z_1\times r\times p$ sheets. At such time, the computer 89 transmits a signal via dividing circuit 91 and gear motor 87 so that the differential transmission 92 subtracts a revolution during each working cycle of the transfer unit 2. Thus, the speed $v_1$ is reduced to $v_2$ and the apparatus thereupon accumulates three layers 21 each of which contains thirtysix sheets ($z_2\times r$) while the ratio of machine cycles to working cycle is six-to-one. Thus, the three larger layers 21 together contain a total of onehundredandeight sheets, and the completed stack contains a total of 498 sheets. The stack is thereupon removed from the station 200 or is identified by insertion of a tab or other identifying means before the machine begins to accumulate a fresh stack.

The change-speed transmission 93 of the transmission arrangement 71 renders it possible to select different values $z_1$, and the adjustable planetary transmission 107 renders it possible to adjust the phase of the transfer unit 2 by way of the feed screw 113. As mentioned above, such adjustment will be necessary when the operation of the transfer unit 2 is out of phase with the operation of the cross cutter 76 and/or supply conveyor 4. The motor 87 and the servomotor 86 ensure accurate adjustment of the transmission arrangement 71, i.e., accurate variations of the frequency at which the transfer unit 2 removes layers 21 from the station 1 and advances such layers toward the station 200, namely into the range of the removing conveyor 3.

The computer 89 can be provided or connected with suitable means for displaying the selected frequency of the transfer unit 2 and/or for keeping a record of variations of such frequency. This is described and shown in the aforementioned copending patent application of Neubüser et al. An advantage of such displaying and recording means is that the apparatus can furnish a complete documentation of the operation of the stack forming machine.

An important advantage of the improved apparatus is that the output of the machine can be increased well beyond the outputs of presently known stacking machines and also that the number n of sheets in a stack can be selected practically at will, as long as such number is divisible by r (i.e., by the number of sheets in a group 8). Another important advantage of the improved apparatus is that the camshaft 38 is driven without interruptions so that it is possible to rapidly change the frequency of removal of layers 21 from the station 1. Moreover, the prime mover 78 which drives the cross cutter 76 by way of the motion transmitting means 78*a* (e.g., a clutch or a coupling) can also drive the camshaft 38 through the medium of the motion transmitting means including the step-down transmission arrangement 71 and gear transmission 67.

By proper angular adjustment of the control shaft 118 of the compensating or differential transmission 92, it is further possible to form stacks wherein the average number n of sheets is not divisible by the number r of sheets per group 8. The utilization of a regulating means (86, 87, 89, 91) which includes a process computer 89 contributes to flexibility of the improved apparatus and renders it possible to fully consider the speed limitations of various units or aggregates of the apparatus. Moreover, and as mentioned above, the computer 89 renders it possible to furnish visible and/or permanently recorded indications of all stages of operation of the apparatus and of the machine which embodies such apparatus.

The illustrated change-speed transmission 93 can be replaced with a two-stage or four- or five-etc. stage transmission without departing from the spirit of the invention. By actuating a selected one of the electromagnetic clutches 99*a* to 99*c*, the attendant can change the basic ratio of machine cycles to working cycle to any one of three different values. As mentioned above, the handwheel 114 for the feed screw 113 can be replaced with a motor which can automatically or otherwise change the angular position of the ring gear 112 of the planetary transmission 107 to thereby change the phase of the transfer unit 2. The differential transmission 92 may be for example the transmission type SR 42,3, produced by HILGER & KERN GmbH, Mannheim, Western Germany. For change-over step gear 86 may be used a transmission known as Paradronic P 500, produced by Machine Comp. S.A. Ferguson, Grünwald/München, Western Germany. Motor 87 may be type D1A6Sb-1112-283, produced by firm Eberhard Bauer, Esslingen, Western Germany.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for forming stacks from sheets consisting of paper or a like flexible material, comprising a first station and a second station; mobile severing means for repatedly severing plural running webs of flexible material so as to form a series of groups of sheets; means for supplying successive groups of said series to said first station; means for gathering groups at said first station into a succession of layers; transfer means for transporting successive layers from said first station toward said second station at a variable frequency so that the number of groups per layer is a function of said frequency; a prime mover; means for transmitting motion from said prime mover to said transfer means, including a transmission arrangement with a whole-number step-down transmission ratio; and regulating means for varying said frequency in accordance with a predetermined program through the medium of said transmission arrangement.

2. The apparatus of claim 1, wherein said transmission arrangement includes a compensating transmission having an input member which receives torque from said prime mover, an output member which is operatively connected with said transfer means, and a mobile control member arranged to receive motion from said regulating means and to thereby vary said frequency through the medium of said output member.

3. The apparatus of claim 2, wherein said input member comprises a rotary cage.

4. The apparatus of claim 2, wherein said motion transmitting means further comprises a rotary camshaft receiving torque from said output member and arranged to move said transfer means.

5. The apparatus of claim 4, wherein said transmission arrangement further comprises a multistage change-speed transmission which is interposed between said output member and said camshaft.

6. The apparatus of claim 4, wherein said transmission arrangement further comprises means for changing the phase of said transfer means including an adjustable transmission interposed between said output member and said camshaft.

7. The apparatus of claim 6, wherein said adjustable transmission is a planetary transmission.

8. The apparatus of claim 7, wherein said planetary transmission comprises a rotary input element receiving torque from said output member, a planet carrier driven by said input element, a sun gear arranged to transmit torque to said camshaft, at least one planet pinion meshing with said sun gear and rotatably mounted on said carrier, a ring gear meshing with said pinion, and means for adjusting the angular position of said ring gear.

9. The apparatus of claim 4, wherein said regulating means comprises a step-by-step servomotor arranged to rotate said control member clockwise and counterclockwise.

10. The apparatus of claim 9, wherein said regulating means further comprises a second motor arranged to drive said servomotor in accordance with said program.

11. The apparatus of claim 4, wherein said regulating means comprises a computer.

12. The apparatus of claim 4, further comprising means for transmitting motion from said prime mover to said severing means.

13. The apparatus of claim 12, further comprising means for varying the speed of said prime mover to thereby vary said frequency as well as the frequency at which the webs are severed by said severing means.

14. The apparatus of claim 4, wherein said transmission arrangement further comprises a multi-stage change-speed transmission receiving torque from said output member and a bevel gear transmission interposed between said change-speed transmission and said camshaft.

15. The apparatus of claim 14, wherein said transmission arrangement further comprises an adjustable planetary transmission interposed between said change-speed transmission and said bevel gear transmission.

16. The apparatus of claim 4, further comprising a gear transmission interposed between said output member and said camshaft.

17. The apparatus of claim 1, further comprising a removing conveyor arranged to transport layers from said transfer means to said second station.

* * * * *